United States Patent [19]

Cooper

[11] Patent Number: 4,890,354

[45] Date of Patent: Jan. 2, 1990

[54] WINDOW SHADE LOCK DEVICE

[75] Inventor: David Cooper, North Hollywood, Calif.

[73] Assignee: Castec, Inc., North Hollywood, Calif.

[21] Appl. No.: 239,945

[22] Filed: Sep. 2, 1988

[51] Int. Cl.[4] ..... E05D 15/00; A47H 3/00; E06B 9/17

[52] U.S. Cl. ..... 16/87 R; 160/275

[58] Field of Search ..... 16/87 R, 87.4 R, 87.6 R, 16/90, 91, 102; 160/257, 274, 275-282, 285, 286, 288, 289, 291, 290.1; 188/42

[56] References Cited

U.S. PATENT DOCUMENTS

| | | | |
|---|---|---|---|
| 672,416 | 4/1901 | Dow | 160/287 |
| 716,208 | 12/1902 | Duchemin | 160/275 |
| 1,061,728 | 5/1913 | Carlson | 160/275 |
| 2,065,813 | 12/1936 | Lang | 160/275 |
| 3,165,076 | 1/1965 | Adler . | |
| 3,329,196 | 7/1967 | Algie . | |
| 3,376,599 | 4/1968 | Singer . | |
| 3,628,588 | 12/1971 | Dixon . | |
| 3,936,906 | 2/1976 | Takazawa | 16/90 |
| 3,986,749 | 10/1976 | Hull et al. . | |
| 4,194,549 | 3/1980 | Lovgren . | |
| 4,320,792 | 3/1982 | Licciardi et al. . | |
| 4,557,310 | 12/1985 | Castellaw et al. . | |

*Primary Examiner*—Nicholas P. Godici
*Assistant Examiner*—Carmine Cuda
*Attorney, Agent, or Firm*—John J. Posta Jr.

[57] ABSTRACT

The window shade lock device includes a handle having a round or elongated hand grip end and a slide connector extending forwardly thereof. The slide connector is pivotally secured, preferably off center, to the preferably generally rectangular body of a slide bearing four spaced, axled, rotatable wheels, two on each of two opposite sides thereof. The wheels are adapted to ride in parallel spaced channels in a window shade side frame. The wheels extend beyond the side margins of the slide body. The slide body extends out of the frame into connection with the connector front end outside the frame. The handle is pivotally movable up and down between a locked and unlocked position. When in the locked position the slide connector front end biases the slide, specifically the wheels thereof, tightly against the frame to hold the lock in position. In the unlocked position the slide connector front end biases and spaces the slide from the frame for free movement therein. Locking of the handle to the frame also locks a window shade secured at its lower end to the handle and/or slide by a shade connector in the form of a flexible or rigid strut or the like. The device is compact, simple and efficient.

7 Claims, 1 Drawing Sheet

WINDOW SHADE LOCK DEVICE

BACKGROUND OF THE INVENTION

1. Field of the Invention

The present invention generally relates to locks and, more particularly, to an improved window shade lock device.

2. Prior Art

Window shades generally are movable between various up or non-shading positions and various down or shade-providing positions by hand cords, ropes and the like or directly by hand. One form of such window shade assembly is set forth in U.S. Pat. No. 4,557,310. That assembly employs a shade disposed between and connected to a parallel pair of guide tracks, with shade carriers riding in the tracks and secured at spaced points to the shade itself.

With such an assembly, it would be desirable to be able to provide a positive hand lock capable of rigidly holding the shade in any desired position relative to the side frames. Such lock should be easy to install, repair, disassemble and use, and should be inexpensive, attractive in appearance and capable of a plurality of sizes and shapes.

SUMMARY OF THE INVENTION

The improved window shade lock device of the present invention satisfies all the foregoing needs. The device is substantially as set forth in the Abstract of Disclosure. Thus, the device includes a handle having a round, elongated or other shape of hand grip, and a slide connector protruding forwardly therefrom. The slide connector is a bar or rod integral with the hand grip and having its front end pivotally secured, preferably in an off-center position to the preferably generally rectangular body of a slide bearing four, spaced, axled rotatable wheels, two on each of two opposite sides of the slide body. The wheels are adapted to ride in spaced parallel channels in a side frame of a shade, such as that disclosed in U.S. Pat. No. 4,557,310 or the like. Fewer or more wheels can be used, as can runners be used in place of or in addition to the wheels. The wheels extend beyond the side margins of the slide body.

The slide body is adapted to extend out of the frame through a central longitudinal opening in the frame, and into pivotal connection with the slide connector, as described above. The handle can be pivoted; that is, moved up and down between locked and unlocked positions. When in the locked position the slide connector front end biases the slide, specifically the wheels thereof, tightly against the frame to hold the lock in position. In the unlocked position the slide connector front end biases and spaces the slide, specifically the wheels thereof, away from the frame for free movement of the slide therein and free movement of the present device.

Locking of the handle to the frame also locks the window shade in position because it is connected at its bottom end to either the handle or slide or both. Thus, when the handle is unlocked it can be used to urge the shade into a desired position, after which the handle can be pivoted to securely lock the shade in that position. The device is simple, efficient, compact, durable, inexpensive and attractive in appearance. Further features of the present invention are set forth in the following detailed description and accompanying drawings.

DRAWINGS

DETAILED DESCRIPTION

Figure 1:
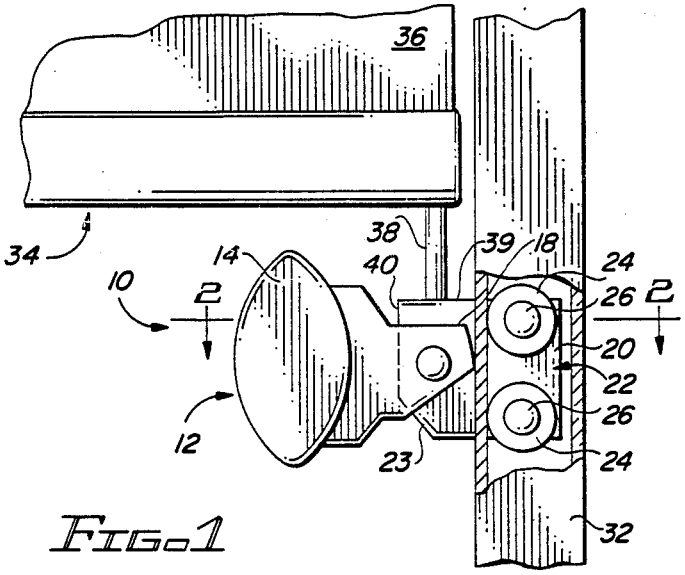
FIG. 1 is a schematic fragmentary side elevation, partly broken away, of a first preferred embodiment of the improved window shade lock device of the present invention, shown in the locked position.
Figure 2:
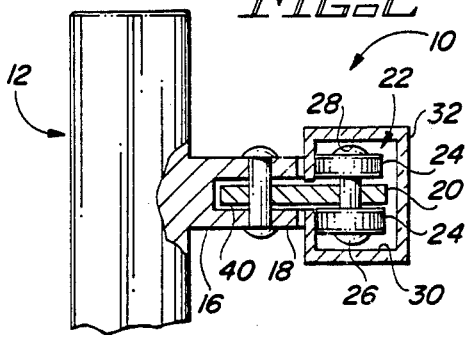
FIG. 2 is a fragmentary cross-sectional view of the device shown in FIG. 1, taken along Section 2—2.

FIGS. 1–4.

Now referring more particularly to FIGS. 1–4 of the drawings, a first preferred embodiment of the improved window shade lock device of the present invention is schematically depicted therein. Thus, device 10 is shown which comprises a handle 12 having a hand grip portion 14 and a slide connector portion 16 integral therewith. Hand grip 14 is a bar which extends transversely of handle 12 and connector 16 is a rod which projects forwardly of grip 14. The front end 18 of connector 16 is pivotally connected in an off-center position to the preferably generally rectangular slide body portion 20 of a slide 22 which also forms part of device 10. Slide body 20 has a somewhat truncated lower end 23.

Slide 22 bears four identical spaced wheels 24 rotatably connected thereto by axles 26 and disposed to a side on each of two opposite sides of body 20. Wheels 24 extend beyond the side margins of body 20. Wheels 24 are adapted to be disposed in and slide and rotate in a spaced pair of channels 28 and 30 in one of the side frames 32 of a window shade assembly 34 of which window shade 36 is a part (FIG. 1).

Device 10 is connected to assembly 34, specifically the bottom of shade 36, by a connector in the form of a strut 38, preferably rigid rather than flexible, which extends upwardly from the upper end 39 of slide body 20, and is integral with the portion 40 of slide body 20 which is external of side frame 32. It will be understood that a cord could, if desired, be used in place of strut 38 to permit device 10 to pull shade 36 down and allow it to follow shade up along frame 32. Such strut 38 or similar cord can, if desired, be attached to handle 12 instead of or in addition to slide 22.

Figure 3:
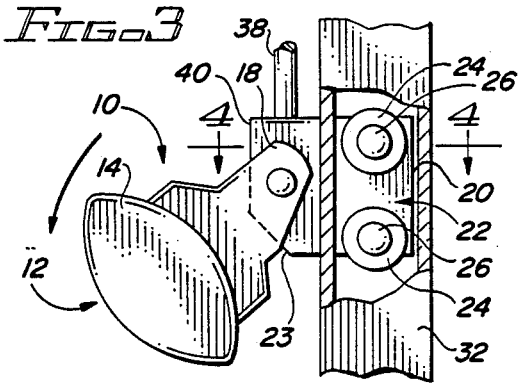
FIG. 3 is a fragmentary schematic side elevation, partly broken away, of the device of FIG. 1 shown in the unlocked position.

When handle 12 is in the unlocked position of FIG. 3, wheels 24 are spaced from the next adjacent portion 42 of side frame 32 so that wheels 24, slide body 20 and handle 12 can move freely up and down relative to frame 32. When handle 12 is moved from the unlocked position of FIG. 3 to the locked position of FIG. 1, that is lifted relative to frame 32, front end 18 of slide connector 16 biases wheels 24 tightly against portion 42 so that device 10 cannot move relative to frame 32, and neither can shade 36 attached to device 10 by strut 38. This biasing is due to the relative size proportions and spacings of the components of device 10, the pivoting action of handle 12 and the offset position of the pivot point thereof. Once locked, device 10 is just as easily unlocked by pushing down on grip 14 and causing handle 12 to pivot down to the unlocked position of FIG. 3.

Accordingly, device 10 is simple to operate and construct, efficient, durable, inexpensive and attractive. It can be made of metal, ceramic, plastic, wood or a combination thereof, as desired.

Figure 5:
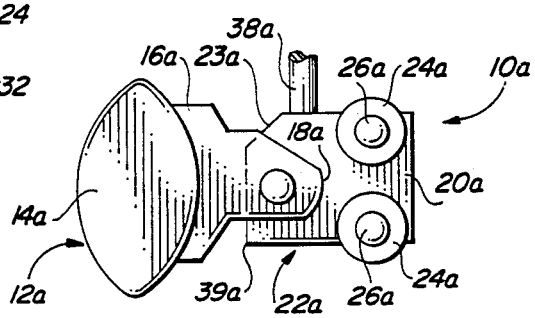
FIG. 5 is a fragmentary schematic side elevation of a second preferred embodiment of the device of the present invention shown in the locked position.
Figure 6:
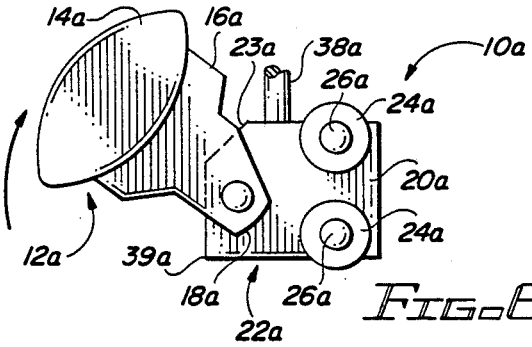
FIG. 6 is a fragmentary schematic side elevation of the device of FIG. 5, shown in the unlocked position with the slide rotated 45°.
Figure 4:
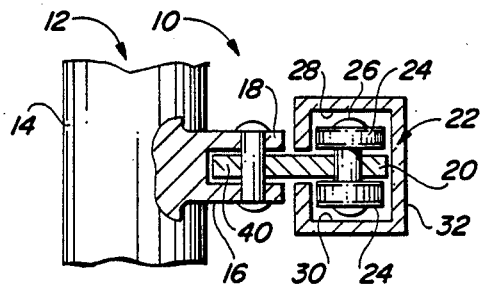
FIG. 4 is fragmentary cross-sectional view of the device shown in FIG. 3, taken along lines 4—4.

FIGS. 5 and 6.

A second preferred embodiment of the improved window shade lock device of the present invention is schematically depicted in FIGS. 5 and 6. Thus, device 10*a* is shown. Components thereof similar to those of device 10 bear the same numerals, but are succeeded by the letter "a". Device 10*a* is identical to device 10 except that ends 23*a* and 39*a* are reversed, truncated end 23*a* being the uppermost and, while end 39 is the lowermost end and handle 12*a* pivots upwardly rather than downwardly from the locked position of FIG. 5 to the unlocked position of FIG. 5. The function, construction and features of device 10*a* are otherwise identical to those of device 10.

Figure 7:
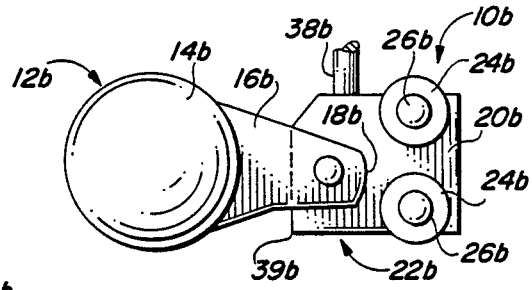
FIG. 7 is a schematic fragmentary side elevation of a third preferred embodiment of the device of the present invention, shown in the locked position; and, FIG. 8 is a schematic fragmentary side elevation of the device of FIG. 7 in the unlocked position.
Figure 8:
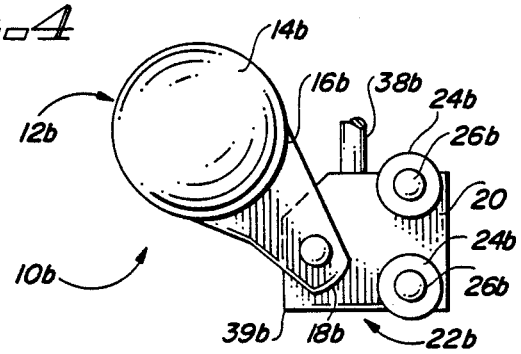

FIGS. 7 and 8.

A third preferred embodiment of the improved window shade lock device of the present invention is schematically depicted in FIGS. 7 and 8. Thus, device 10*b* is shown. Components thereof similar to those of device 10 and/or device 10*a* bear the same numerals but are succeeded by the letter "b". Device 10*b* is identical in construction to device 10*a* except that handle 12*b* is round, like a door knob, and slide connector 16*b* has a different shape from that of connector 16*a*. Device 10*b* has the same functions and advantages as device 10*a*.

Various other modifications, changes, alterations and additions can be made in the improved window shade lock device of the present invention, its components and parameters. All such modifications, changes, alterations and additions as are within the scope of the appended claims form part of the present invention.

What is claimed is:

1. An improved window shade lock device, said device comprising, in combination:

(a) a handle having a hand grip and a slide connector extending forwardly thereof; and, (b) a slide pivotally secured to the front end of said slide connector at a pivot point for movement between a locked and an unlocked position, said slide being adapted to slide on the inside of a channeled window shade side frame and to extend outwardly thereof through an opening in said side frame for connection with said slide connector outside said side frame, whereby in said locked position said slide connector front end is wedged between the frame and said pivot point to thereby bias said slide tightly against said frame to hold it in locked position, and in said unlocked position said slide connector front end is not wedged between the frame and said pivot point to thereby allow spacing of said slide from said frame for free movement therein; at least one of said handle and said slide being secured by a shade connector to the lower end of a window shade for simultaneous movement of said lock device and window shade.

2. The improved window shade lock device of claim 1 wherein said slide includes a generally rectangular body an 4 spaced rotatable wheels disposed on axles, two of aid wheels being on each of two opposite sides of said slide body thereof, said wheels extending beyond the side margins of said slide body and being adapted to ride in spaced paired parallel channels in said side frame.

3. The improved window shade lock device of claim 2 wherein said handle includes a transversely extending hand grip and wherein said front end of said slide connector is pivotally connected to said slide body at an off-center point, disposed away from the longitudinal midline of said slide connector and said slide body.

4. The improved window shade lock device of claim 3 wherein said slide is plastic and said handle is metal.

5. The improved window shade lock device of claim 1 wherein said handle is a round knob with a tapered rod slide connector attached thereto and wherein said shade connector comprises a metallic strut securable to the underside of a window shade.

6. The improved window shade lock device of claim 5 wherein said strut is made from rigid material.

7. The improved window shade lock device of claim 5 wherein said strut is made from flexible material.

* * * * *